US009919909B2

(12) United States Patent
Cohen et al.

(10) Patent No.: US 9,919,909 B2
(45) Date of Patent: Mar. 20, 2018

(54) SYRUP PUMP AND CONTROLLER

(71) Applicants: Avihay Cohen, Qiryat Bialik (IL); Robert R. Kimberlin, Murfreesboro, TN (US)

(72) Inventors: Avihay Cohen, Qiryat Bialik (IL); Robert R. Kimberlin, Murfreesboro, TN (US)

(73) Assignees: Arbel Agencies Limited (IL); Standex International Corporation, Salem, NH (US)

( * ) Notice: Subject to any disclaimer, the term of this patent is extended or adjusted under 35 U.S.C. 154(b) by 25 days.

(21) Appl. No.: 15/235,854

(22) Filed: Aug. 12, 2016

(65) Prior Publication Data

US 2018/0044157 A1 Feb. 15, 2018

(51) Int. Cl.

| | |
|---|---|
| ***B67D 1/00*** | (2006.01) |
| ***B67D 1/08*** | (2006.01) |
| ***B67D 1/10*** | (2006.01) |
| ***B67D 1/12*** | (2006.01) |

(52) U.S. Cl.

CPC ..... *B67D 1/0021* (2013.01); *B67D 1/0044* (2013.01); *B67D 1/0888* (2013.01); *B67D 1/10* (2013.01); *B67D 1/1231* (2013.01)

(58) Field of Classification Search

CPC .. B67D 1/0021; B67D 1/0044; B67D 1/0888; B67D 1/10; B67D 1/108; B67D 1/1231; B67D 1/1222

USPC ..... 417/19, 31, 44.2, 44.4

See application file for complete search history.

(56) References Cited

U.S. PATENT DOCUMENTS 4,505,643 A * 3/1985 Millis ..... E04H 4/1245 210/138
4,551,069 A * 11/1985 Gilmore ..... F04C 14/06 417/13
4,744,729 A * 5/1988 Hasten ..... G05D 9/12 417/12

(Continued)

FOREIGN PATENT DOCUMENTS

EP 2070586 A1 6/2009
EP 1952699 B1 12/2009

(Continued)

*Primary Examiner* — Nicholas J Weiss
(74) *Attorney, Agent, or Firm* — Luedeka Neely Group, P.C.

(57) ABSTRACT

A beverage syrup pump system is disclosed including a pump housing having an internal pumping chamber, a pump motor, and a pumping mechanism driven by the motor within the pumping chamber. The pumping mechanism receives a syrup fluid at a first pressure and discharges the fluid at a second pressure which is greater than the first pressure. A pressure transducer adjacent a sensor port and in contact with a quantity of the fluid at the second pressure generates an electrical signal based upon the second pressure. A programmable micro controller receives the electrical signal from the pressure transducer and is capable of starting and stopping the pump motor. The micro controller will immediately stop the pump motor if the second pressure exceeds a predetermined maximum pressure level. The micro controller will also stop the pump motor if the second pressure falls and remains below a predetermined minimum pressure level for a predetermined first time interval.

14 Claims, 9 Drawing Sheets

(56) References Cited

U.S. PATENT DOCUMENTS 4,787,332 A * 11/1988 Geisel ..... F04C 2/086 118/410
5,012,837 A 5/1991 Zepp
5,024,294 A * 6/1991 Van Fossen ..... F01M 1/22 184/108
5,156,301 A 10/1992 Hassell et al.
5,197,859 A * 3/1993 Siff ..... F04B 49/022 417/19
5,203,803 A * 4/1993 Schoenmeyr ..... B01D 61/10 137/512.2
5,244,351 A * 9/1993 Arnette ..... F04D 15/0218 137/202
5,673,820 A 10/1997 Green et al.
5,730,324 A 3/1998 Shannon et al.
RE35,780 E 5/1998 Hassell et al.
6,269,973 B1 * 8/2001 Bennett ..... B67D 1/0036 222/1
6,630,028 B2 * 10/2003 Briese ..... E04F 21/28 118/315
6,837,688 B2 * 1/2005 Kimberlin ..... F04D 13/064 417/32
8,441,222 B2 * 5/2013 Manzarek ..... F04B 51/00 318/443
8,485,393 B2 7/2013 Van Zeeland
8,561,470 B2 * 10/2013 Kurtz ..... G01L 7/022 73/715
8,701,939 B2 4/2014 Frank et al.
9,789,645 B2 * 10/2017 Otruba ..... B29C 65/525
2006/0208913 A1 9/2006 Christoffersen et al.
2012/0134847 A1 * 5/2012 Conley ..... F16N 7/14 417/15
2012/0223094 A1 * 9/2012 Rickard, Jr. ..... A23G 9/045 222/1
2013/0106690 A1 5/2013 Lim
2013/0343906 A1 * 12/2013 Funke ..... F02N 11/0803 417/10
2014/0092705 A1 4/2014 Riel

FOREIGN PATENT DOCUMENTS

EP 2256072 A1 12/2010
GB 1364522 8/1974
GB 2140389 A 11/1984
WO 9211082 A1 7/1992

* cited by examiner

SYRUP PUMP AND CONTROLLER

FIELD

This disclosure relates to the field of fluid pumps. More particularly, this disclosure relates to a pump and related controller system for a post-mix beverage dispenser system.

BACKGROUND

Post-mix beverage dispensers combine carbonated water with a concentrated beverage syrup to provide a final beverage for dispensing and consumption. The beverage syrup, which is often a dense and/or viscous fluid, is typically supplied from a bag-in-box syrup container. A syrup pump may be used to move the syrup from the syrup container to the dispensing nozzle.

Conventionally, this syrup pump is a diaphragm-type pump, which is driven by a compressed gas source. In many instances, the compressed gas source may be compressed carbon dioxide, which is also used for preparing the carbonated water. Syrup pumps of this type have at least two disadvantages. First, the pumps use rubber diaphragms which come in contact with the syrup being pumped and quickly absorb flavors from the syrup, and these flavors may subsequently be leached outed into other fluids which later pass through the pump. Thus once the diaphragms in a pump become saturated with the flavor of a given syrup, the pump cannot be repurposed to pump a different flavored beverage without having a detrimental effect on the flavor the new beverage. The pump becomes effectively dedicated to a single flavor of beverage syrup.

Secondly, and more significantly, gas driven diaphragm pumps are prone to leakage of the compressed gas used to drive the pump. Again, in post-mix beverage dispensers, this gas is typically carbon dioxide, which is colorless, odorless, and which presents an asphyxiation hazard in confined spaces.

Accordingly, what is desired is an improved syrup pump for a beverage dispenser which would eliminate the problem of flavor cross-contamination when pumps are repurposed for different flavored beverages. It is also desired to provide a syrup pump for a beverage dispenser which would eliminate the asphyxiation hazard associated with the use of compressed carbon dioxide or other inert gases.

SUMMARY

The above and other needs are met a syrup pump and controller system made in accordance with the present disclosure.

In a first aspect, the present disclosure provides a pump and controller system. In one embodiment, the pump and controller system includes a pump housing having an internal pumping chamber, an inlet port, an outlet port, and a sensor port. Each of the aforementioned ports are in flow communication with the pumping chamber. The pump and controller system also includes a pump motor and a pumping mechanism driven by the pump motor. This pumping mechanism is at least partially disposed within the pumping chamber, the pumping mechanism being capable of receiving a fluid through the inlet port into the pumping chamber at a first pressure and discharging the fluid from the pumping chamber through the outlet port at a second pressure which is greater than the first pressure.

The pump and controller system also includes a pressure transducer disposed adjacent the sensor port. This transducer is in contact with a quantity of the fluid at the second pressure and generates an electrical signal based upon the second pressure.

A programmable micro controller is also included which receives the electrical signal from the pressure transducer, and is electrically connected to the pump motor and capable of starting and stopping the pump motor. The micro controller is programmed to immediately stop the pump motor if the second pressure exceeds a predetermined maximum pressure level. The micro controller is also programmed to stop the pump motor if the second pressure falls below a predetermined minimum pressure level and remains below this minimum pressure level for a predetermined first time interval.

In certain embodiments of the pump and controller system, the pump is a gear pump. In these embodiments, the pumping mechanism preferably includes a drive gear, having a plurality of drive gear teeth, which is disposed within the pumping chamber and rotatably driven by the pump motor. The pumping mechanism also preferably includes an idler gear, having a plurality of idler gear teeth intermeshed with the drive gear teeth, which is disposed within the pumping chamber and attached to an idler shaft disposed within the pumping chamber. The sensor port is located downstream of the drive gear and the idler gear.

In certain embodiments of the pump and controller system, the pressure transducer preferably includes a ceramic piezo disc.

In some embodiments of the pump and controller system, the micro controller is also preferably programmed to restart the pump motor if, after exceeding the predetermined maximum pressure level, the second pressure falls below the predetermined maximum pressure level.

In certain embodiments, the pump and controller system also preferably includes a temperature transducer disposed adjacent the sensor port. This temperature transducer is in contact with a quantity of the fluid and generates an electrical signal based upon a temperature of the fluid which is received by the programmable micro controller.

In some instances, the pump and controller system also preferably includes a data port electrically connected to the micro controller for transmitting data from the micro controller to an external device. In certain embodiments, the pump and controller system also preferably includes a wireless transmitter and receiver electrically connected to the micro controller for transmitting data from the micro controller to an external device.

In a second aspect, the present disclosure provides a post-mix beverage dispenser. In one embodiment, the post-mix beverage dispenser includes a beverage mixing and dispensing nozzle and a supply of carbonated water in flow communication with the beverage mixing and dispensing nozzle. The post-mix beverage dispenser also includes a supply of beverage syrup and a beverage syrup pump system.

The beverage syrup pump system, in turn, includes a pump housing having an internal pumping chamber, an inlet port, an outlet port, and a sensor port. Each of the aforementioned ports are in flow communication with the pumping chamber. The pump and controller system also includes a pump motor and a pumping mechanism driven by the pump motor. This pumping mechanism is at least partially disposed within the pumping chamber, the pumping mechanism being capable of receiving a syrup fluid through the inlet port into the pumping chamber at a first pressure and discharging the fluid from the pumping chamber through the outlet port at a second pressure which is greater than the first pressure.

The pump and controller system also includes a pressure transducer disposed adjacent the sensor port. This transducer is in contact with a quantity of the fluid at the second pressure and generates an electrical signal based upon the second pressure.

A programmable micro controller is also included which receives the electrical signal from the pressure transducer, and is electrically connected to the pump motor and capable of starting and stopping the pump motor. The micro controller is programmed to immediately stop the pump motor if the second pressure exceeds a predetermined maximum pressure level. The micro controller is also programmed to stop the pump motor if the second pressure falls below a predetermined minimum pressure level and remains below this minimum pressure level for a predetermined first time interval.

In certain embodiments of the post-mix beverage dispenser, the pump is a gear pump. In these embodiments, the pumping mechanism preferably includes a drive gear, having a plurality of drive gear teeth, which is disposed within the pumping chamber and rotatably driven by the pump motor. The pumping mechanism also preferably includes an idler gear, having a plurality of idler gear teeth intermeshed with the drive gear teeth, which is disposed within the pumping chamber and attached to an idler shaft disposed within the pumping chamber. The sensor port is located downstream of the drive gear and the idler gear.

In certain embodiments of the post-mix beverage dispenser, the pressure transducer preferably includes a ceramic piezo disc.

In some embodiments of the post-mix beverage dispenser, the micro controller is also preferably programmed to restart the pump motor if, after exceeding the predetermined maximum pressure level, the second pressure falls below the predetermined maximum pressure level.

In certain embodiments, the post-mix beverage dispenser also preferably includes a temperature transducer disposed adjacent the sensor port. This temperature transducer is in contact with a quantity of the fluid and generates an electrical signal based upon a temperature of the fluid which is received by the programmable micro controller.

In some instances, the post-mix beverage dispenser also preferably includes a data port electrically connected to the micro controller for transmitting data from the micro controller to an external device. In certain embodiments, the pump and controller system also preferably includes a wireless transmitter and receiver electrically connected to the micro controller for transmitting data from the micro controller to an external device.

Thus according to the present disclosure, a post-mix beverage dispenser is disclosed which does not utilize a gas driven diaphragm pump in order to pump the beverage syrup. This provides at least two advantages. First of all, by eliminating the diaphragm pump, the beverage syrup being pumped is no longer in contact with the rubber diaphragms used in such pumps. More preferably, the beverage syrup does not contact any components made from rubber as the syrup moves through the syrup pump. Thus, the problem of syrup flavors being absorbed by the rubber components and subsequently leaching out into other beverage syrups (i.e. flavor cross-contamination) is eliminated. Consequently, the syrup pumps according to the present disclosure may be readily repurposed for different flavored beverages if desired.

In addition, by eliminating the gas driven diaphragm pump, the risk of leakage of carbon dioxide or other inert gases from the diaphragm pump is likewise eliminated. Thus, the significant confined space asphyxiation hazard presented by such carbon dioxide leaks is also eliminated.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
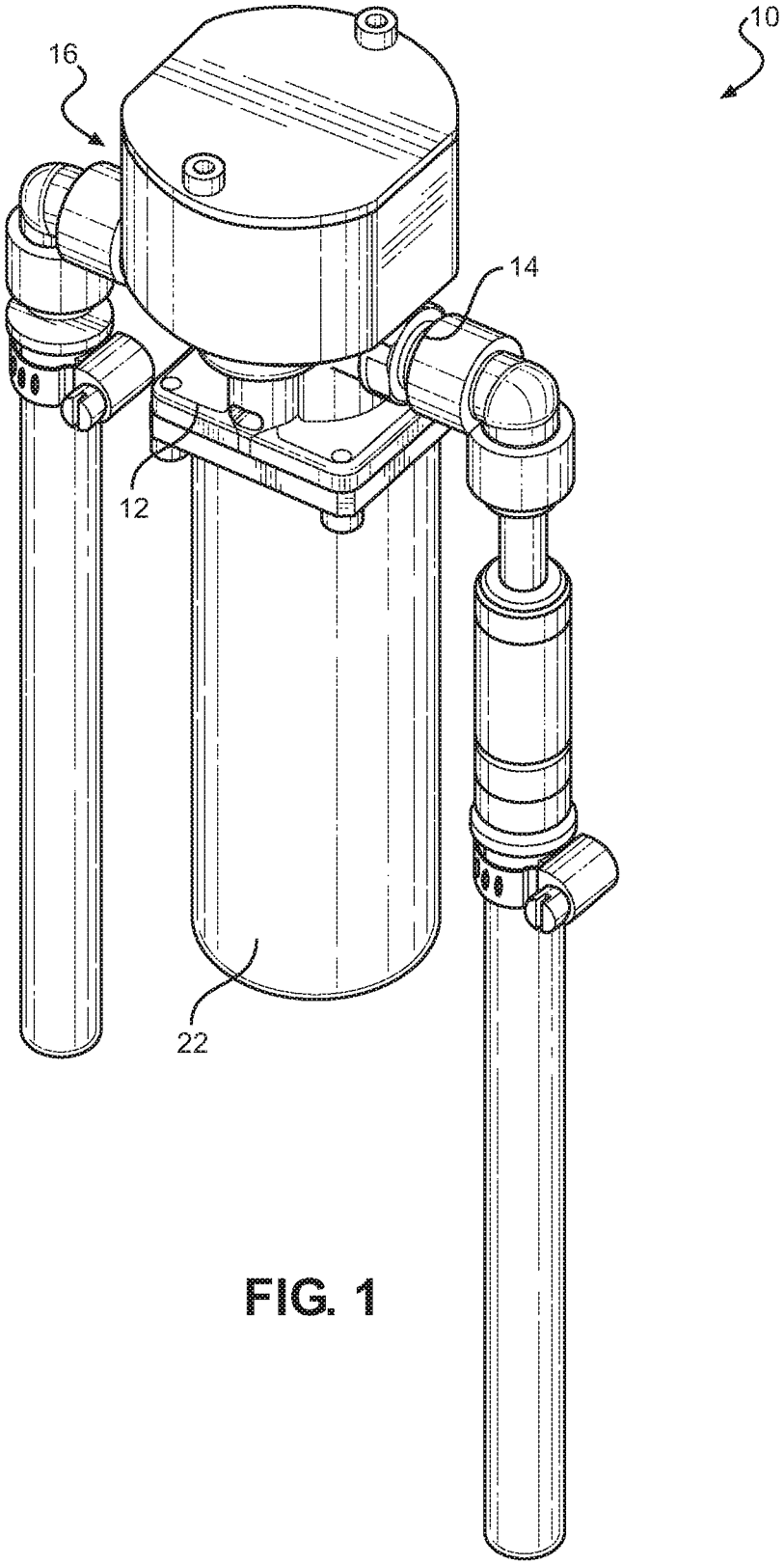
FIG. 1 is a front perspective view of a pump and controller system in accordance with one embodiment of the present disclosure.
Figure 2:
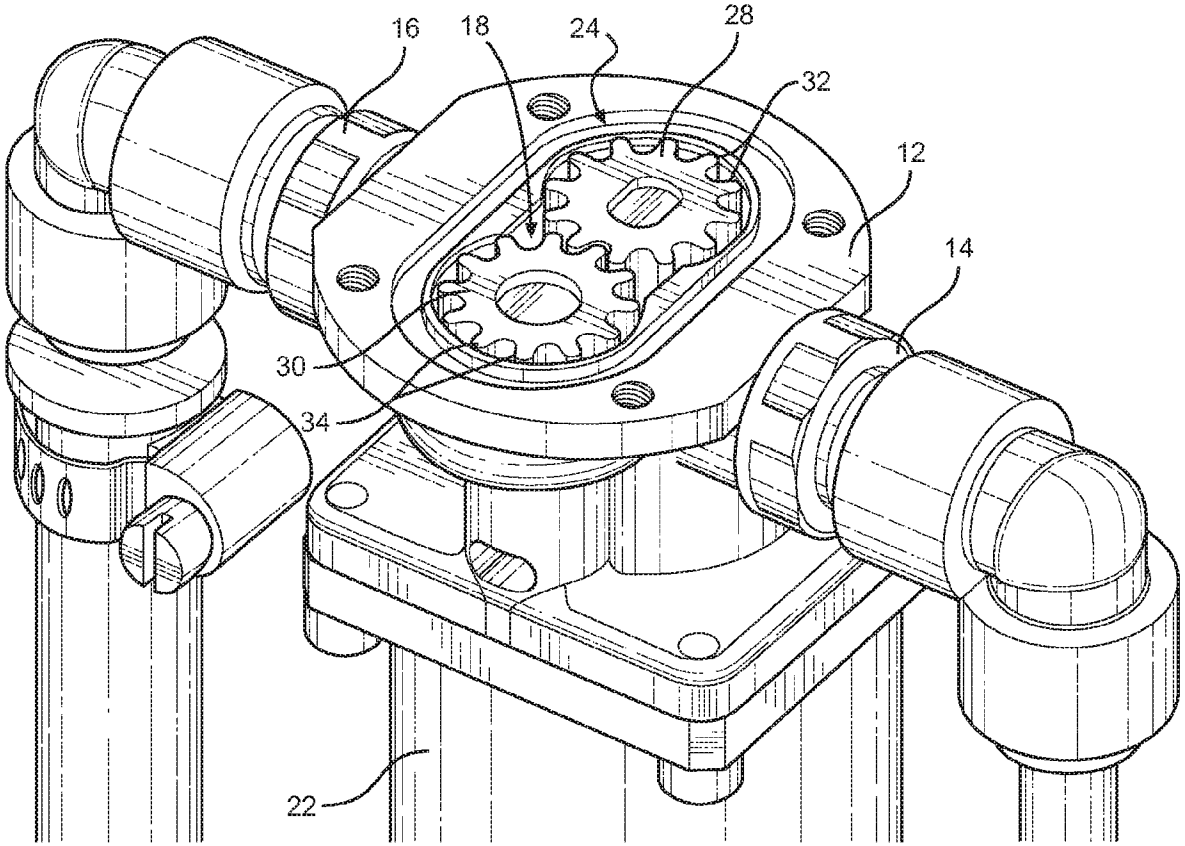
FIG. 2 is a top perspective view of a portion of a pump in accordance with one embodiment of the present disclosure.
Figure 3:
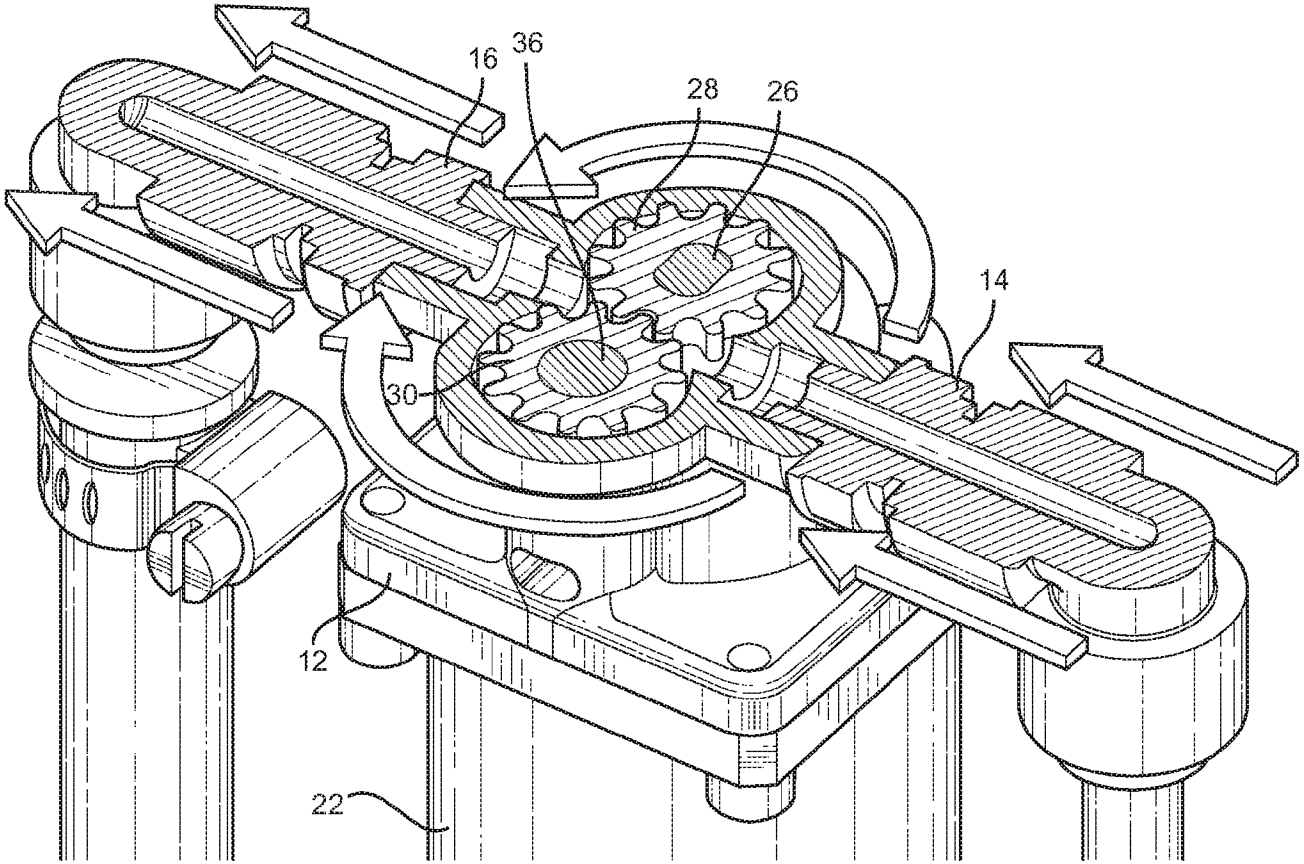
FIG. 3 is a top cross-sectional view of a portion of a pump in accordance with one embodiment of the present disclosure.

The present disclosure relates to a pump and a related pump controller system. The pump and controller systems is particularly suited for pumping beverage syrups in a post-mix beverage dispenser.

As shown in FIGS. 1-4, a pump according to the present disclosure includes a pump housing 12 which is generally formed from a high strength material, such as brass, stainless steel, or another metal or alloy. Alternatively, the pump housing 12 may be molded from a polymeric material, preferably a polymeric material embedded with a fiber reinforcement material, such as carbon fiber or fiberglass filaments.

The pump housing 12 includes an inlet port 14 and an outlet port 16, both of which are in fluid communication with an internal pumping chamber 18 disposed within the pump housing 12. In addition, the pump housing 12 also includes a sensor port 20, as discussed in more detail below.

The fluid pump includes a motor 22. The pump motor 22 is preferably an electric motor 22; however, the pump motor 22 may alternatively be powered by other means such as by fuel combustion. A pump drive shaft 26 is generally attached to the pump motor 22 and driven thereby. The pump drive shaft 26 is preferably made from a metal such as steel.

The pump also includes a pumping mechanism 24 which is at least partially disposed within the pumping chamber 18.

The pumping mechanism 24, which is described in more detail below, is capable of receiving a fluid through the inlet port 14 into the pumping chamber 18 at a first pressure and discharging the fluid from the pumping chamber 18 through the outlet port 16 at a second pressure which is greater than the first pressure.

The pumping mechanism 24 is driven by the pump motor 22 via the drive shaft 26. In some instances, the drive shaft 26 may be directly coupled to the pumping mechanism 24. In such cases, the pump housing 12 further includes a drive shaft opening through which the drive shaft 26 extends into the pump housing 12 and a seal to prevent fluid leakage through the drive shaft opening. In other instances, the drive shaft 26 may be magnetically coupled to the pumping mechanism 24, thereby eliminating the need for an additional seal.

The nature of the pumping mechanism 24 may vary in different embodiments of the present disclosure. In some instances, the pumping mechanism 24 may be a centrifugal pumping mechanism 24. In other instances, the pumping mechanism 24 may be a positive displacement pumping mechanism 24. For instance, in one embodiment, the pump may be provided as a positive displacement rotary vane pump, and the pumping mechanism 24 may include a pump liner disposed within the pumping chamber 18, together with other moving and static pump parts, such as a rear cap, endplate, O-rings, bearings, seals, rotor, vanes, alignment pins, snap rings, shaft, pressure relief valve, port inserts, washers, inlet strainer, and the like.

In another preferred embodiment, the pump may be provided as a positive displacement gear pump. According to this embodiment, the pump housing 12 is preferably oval shaped and, as discussed above, includes an internal pumping chamber 18, an inlet port 14, and an outlet port 16. The pump housing 12 further includes a drive shaft opening through which the drive shaft 26 extends into the pump housing 12. The pumping mechanism 24 includes a drive gear 28 and an idler gear 30. The drive gear 28 includes a plurality of drive gear teeth 32 and is disposed within the pumping chamber 18 and rotatably driven by the drive shaft 26. The idler gear 30 includes a plurality of idler gear teeth 34 which are intermeshed with the drive gear teeth 32 so that the idler gear 30 is rotatable when the drive gear 28 is driven by the drive shaft 26. The idler gear 30 is also disposed within the pumping chamber 18 and is attached to an idler shaft disposed within the pumping chamber 18. The pump housing 12 may also include a pressure plate 38 which is removably fastened to the main body of the pump housing 12.

During operation of the gear pump, fluid is received into the pumping chamber 18 from the inlet port 14 at a first or initial pressure. The drive shaft 26 rotates the drive gear 28 which in turn rotates the idler gear 30 due to the intermeshed teeth 32, 34 of the two gears 28, 30. As the two gears rotate, fluid is trapped by the gear teeth. The fluid then travels around the inner perimeter of the pumping chamber 18 until it is forced out through the outlet port 16 at a second pressure which is greater than the first or initial pressure. The flow path of the fluid through the pumping chamber is illustrated graphically with arrows in FIG. 3.

Figure 5:
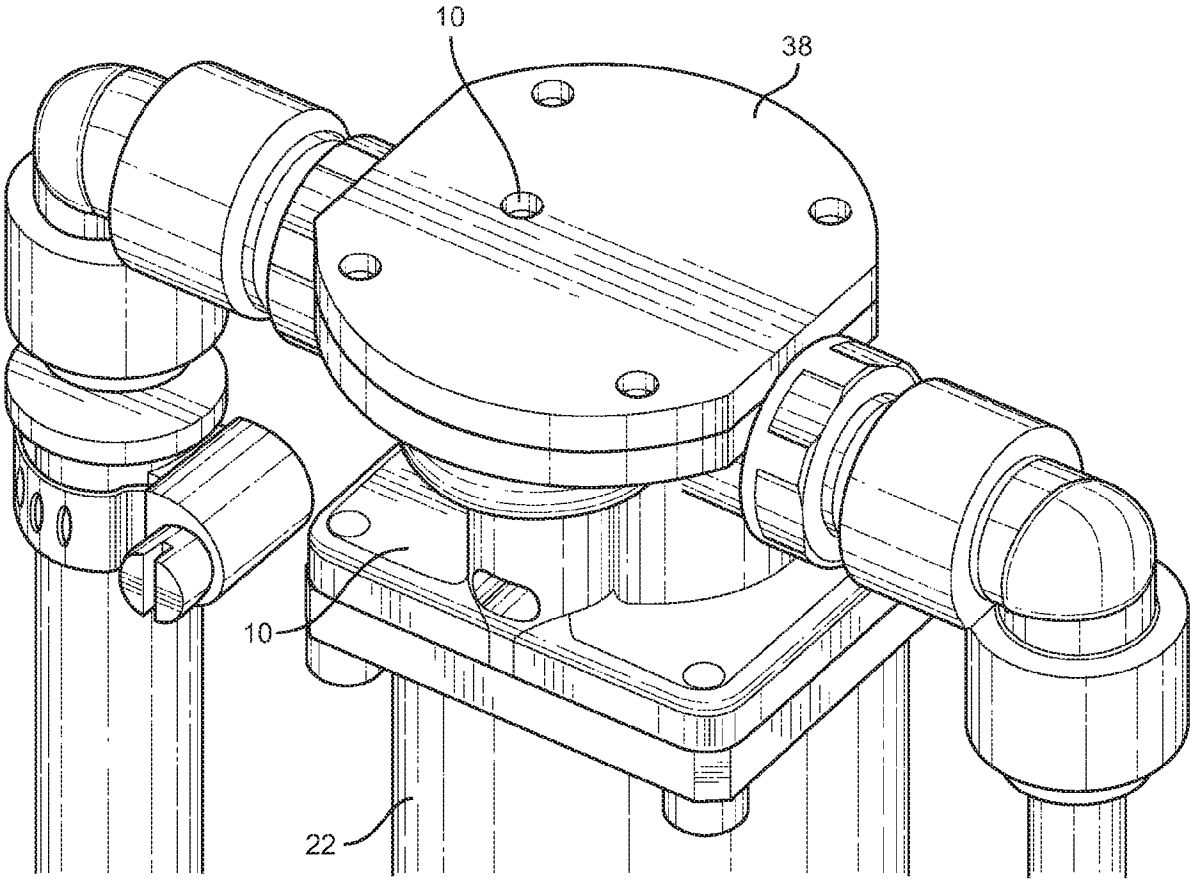
FIG. 5 is a further top perspective view of a pump in accordance with one embodiment of the present disclosure.

As noted above, the pump housing 12 also includes a sensor port 20. For instance, a sensor port 20 may be formed in a pressure plate 38 which is removably fastened to the main body of the pump housing 12, as shown in FIG. 5. The sensor port 20 is generally located so as to be adjacent a portion of the syrup or other fluid which has already based through the drive and idler gears 28, 30 of the pumping mechanism 24, i.e., a quantity of the fluid at the on the discharge side of the pump and at the higher, second pressure.

Figure 7:
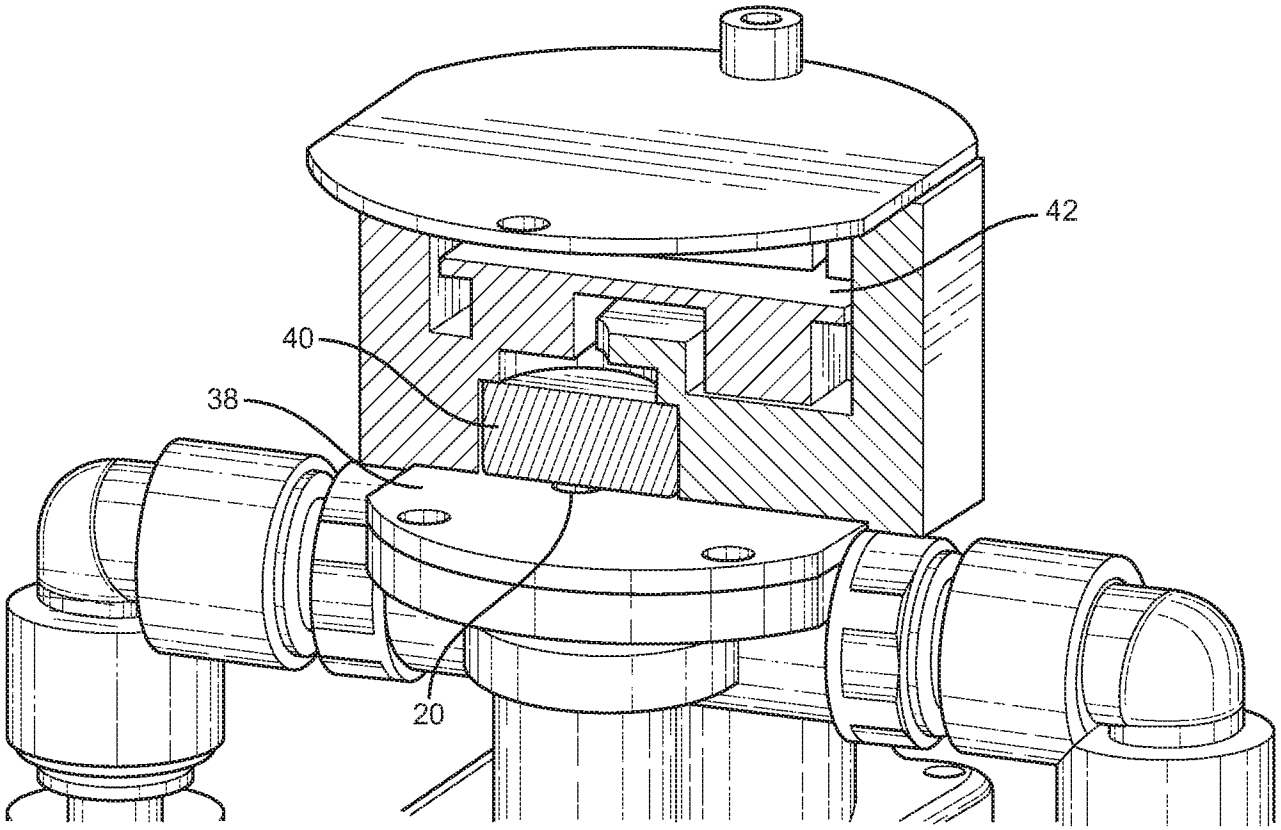
FIG. 7 is a side cross-sectional view of a pump controller system in accordance with one embodiment of the present disclosure.

The pump and controller system also includes a pressure transducer 40, which is positioned adjacent the sensor port 20, as shown in FIG. 7. Being adjacent the sensor port 20, the transducer 40 is in contact with a quantity of the fluid at the second pressure and generates an electrical signal based upon the second pressure. In general, the pressure transducer 40 preferably includes a ceramic piezo disc which generates an electrical voltage which is proportional to the second pressure; however, other forms of pressure transducers such as capacitive pressure transducers may also be used in accordance with the present disclosure. Preferably, however, such pressure transducers are constructed without the use of rubber shielding or other rubber materials which might come in contact with the fluid being pumped.

In some instances, a second sensor, such as a temperature transducer, is also included and disposed adjacent the sensor port 20. For instance, the pump and controller system may include a thermocouple. Like the pressure transducer 40, this temperature transducer is in contact with a quantity of the fluid and generates an electrical signal based upon a temperature of the fluid which is received by the programmable micro controller 42.

Figure 4:
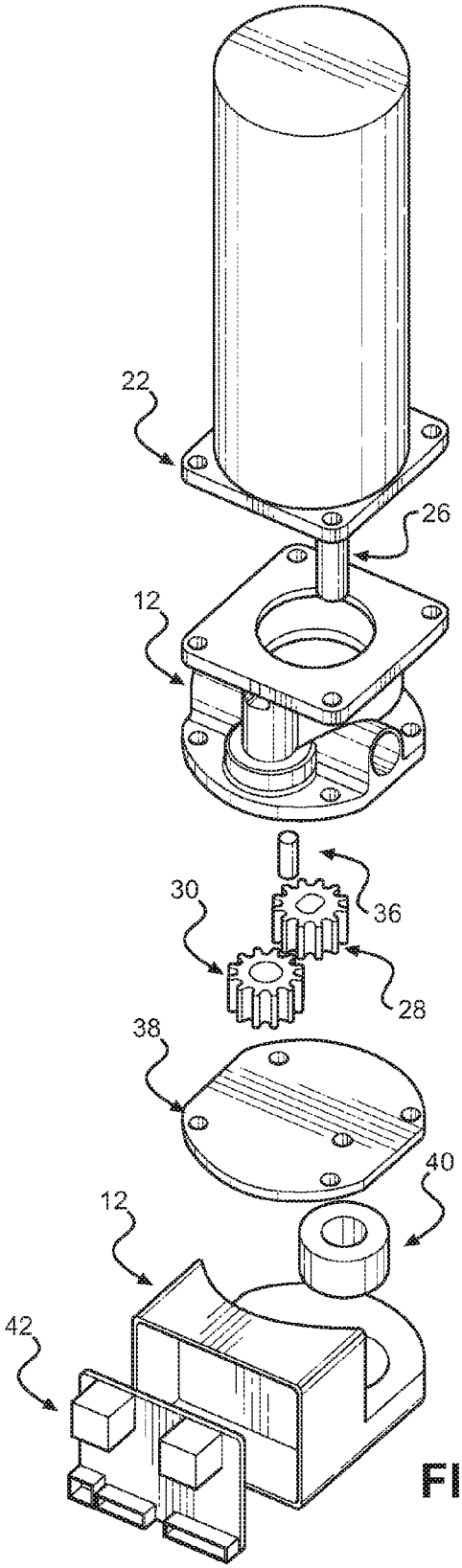
FIG. 4 is an exploded perspective view of a portion of a pump and controller system in accordance with one embodiment of the present disclosure.
Figure 6:
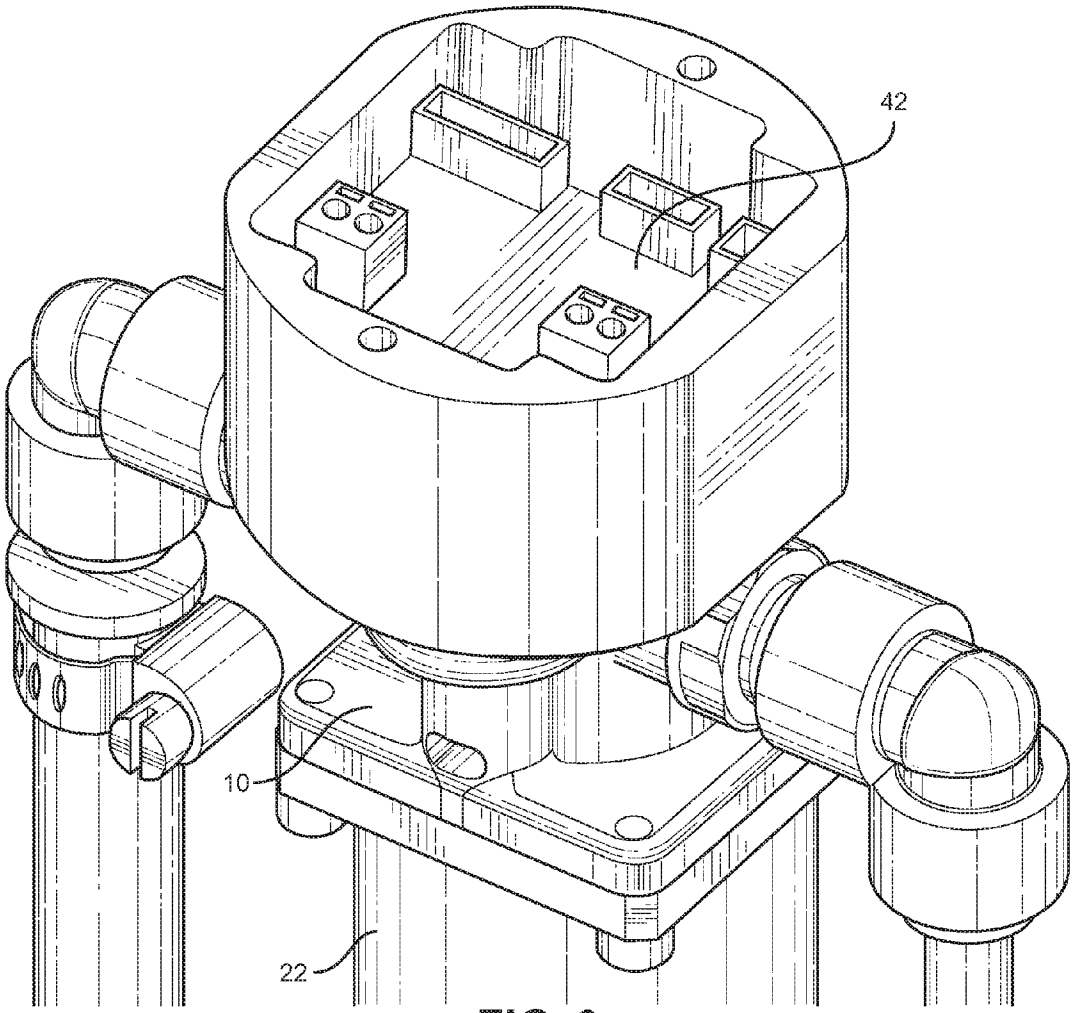
FIG. 6 is a top perspective view of a pump controller system in accordance with one embodiment of the present disclosure.

The pump and controller system also includes a programmable micro controller 42, as illustrated in FIGS. 6 & 7. The micro controller 42 receives the electrical signal from the pressure transducer 40, and also receives the electrical signal from the temperature transducer, if present. The micro controller 42 is also electrically connected to the pump motor 22 so as to be capable of starting and stopping the pump motor 22. The micro controller 42 may be preferably located within an enclosure formed as a part of the pump housing 12 or attached to the pump housing. In certain embodiments, the micro controller 42 may be located in an enclosure located at the end of the pump housing 12, as shown in FIG. 6. Alternatively, the micro controller 42 may be located in an enclosure located on the side of the pump housing 12, as shown in FIG. 4.

The micro controller 42 is programmed to stop the pump motor 22 under certain specified conditions. For instance, the micro controller 42 is programmed to immediately stop the pump motor 22 if the second pressure exceeds a predetermined maximum pressure level. This maximum pressure level is programmed into the micro controller 42 and may set by the end user depending upon the specific circumstances in which the pump and controller system are being used. In a typical post-mix beverage dispenser application, this maximum pressure level may be set at from about 40 psig to about 80 psig.

The micro controller 42 is also programmed to stop the pump motor 22 if the second pressure falls below a predetermined minimum pressure level and remains below this minimum pressure level for a predetermined first time interval. This prevents the pump from running for an extended time in a low pressure (i.e. vacuum) condition. Here again, the minimum pressure level and the first time interval are programmed into the micro controller 42 and may set by the end user depending upon the specific circumstances in which the pump and controller system are being used. In a typical post-mix beverage dispenser application, the minimum pressure level may be set at from about 5 psig to about 10 psig. The first time interval may be set at from about 6 to about 20 seconds. Once the micro controller 42 stops the pump motor 22 due to a low pressure condition, a manual reset is generally required to restart the pump motor 22.

In some instances, the micro controller 42 may also be programmed to restart the pump motor 22 after it has been stopped. For instance, the micro controller 42 may be programmed to restart the pump motor 22 if, after exceeding the predetermined maximum pressure level, the second pressure falls below the predetermined maximum pressure level. In a typical post-mix beverage dispenser application, the micro controller 42 may be programmed to restart the pump motor 22 immediately after the second pressure falls below the predetermined maximum pressure level.

Preferably, the pump and controller systems may also include a manual reset switch 44 which is electrically connected to the micro controller 42 in order to allow manual restarting of the pump motor 22 in circumstances in which the micro controller 42 is not programmed to automatically restart the pump motor 22. For example, if the micro controller 42 has stopped the pump motor 22 due to a vacuum situation (i.e., the second pressure falls below a predetermined minimum pressure level and remains below this minimum pressure level for a predetermined first time interval), the micro controller 42 is preferably not programmed to automatically restart the pump motor 22 after this occurrence. Rather, the use of the manual reset switch 44 is preferably required instead.

Figure 9:
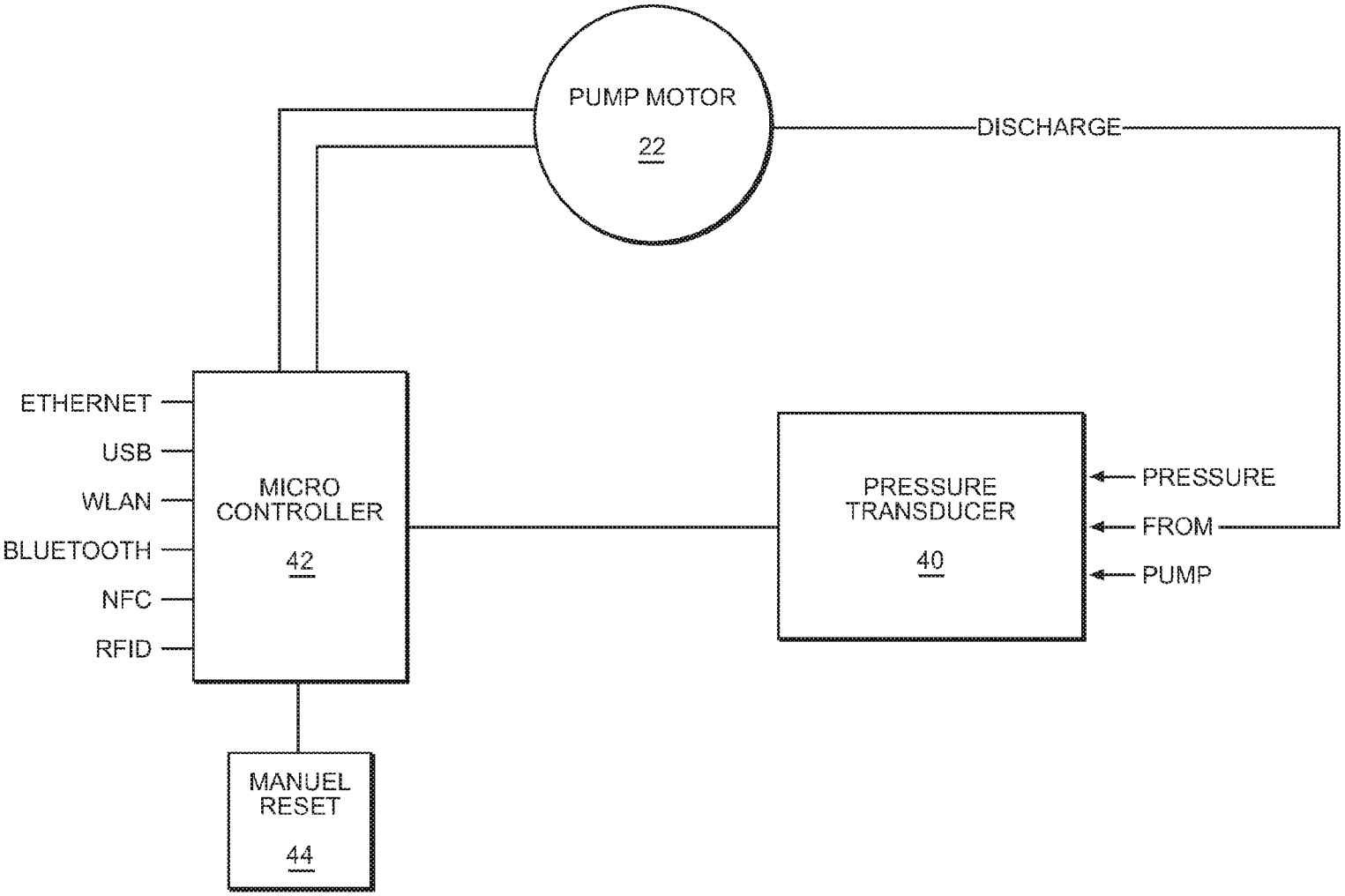
FIG. 9 is schematic diagram illustrating electrical connections for a pump controller system in accordance with one embodiment of the present disclosure.

Optionally, as illustrated in FIG. 9, the pump and controller system may also include one or more components for relaying data from a pressure transducer 40, a temperature transducer, or any other sensor which is connected to the micro controller 42. For instance, the pump and controller system may include a data port, such as an Ethernet port or a USB port which is electrically connected to the micro controller 42. This data port may be used for transmitting data, such as pressure or temperature information, from the micro controller 42 to an external device. In instances, the pump and controller system may include a wireless transmitter and receiver which are electrically connected to the micro controller 42. This wireless transmitter and receiver may wirelessly transmit data, such as pressure or temperature information, from the micro controller 42 to an external device. This information may, for instance, be wirelessly transmitted via a wireless local area network (WLAN), Bluetooth communication, near field communication (NFC), or by radio-frequency identification (RFID).

Figure 8:
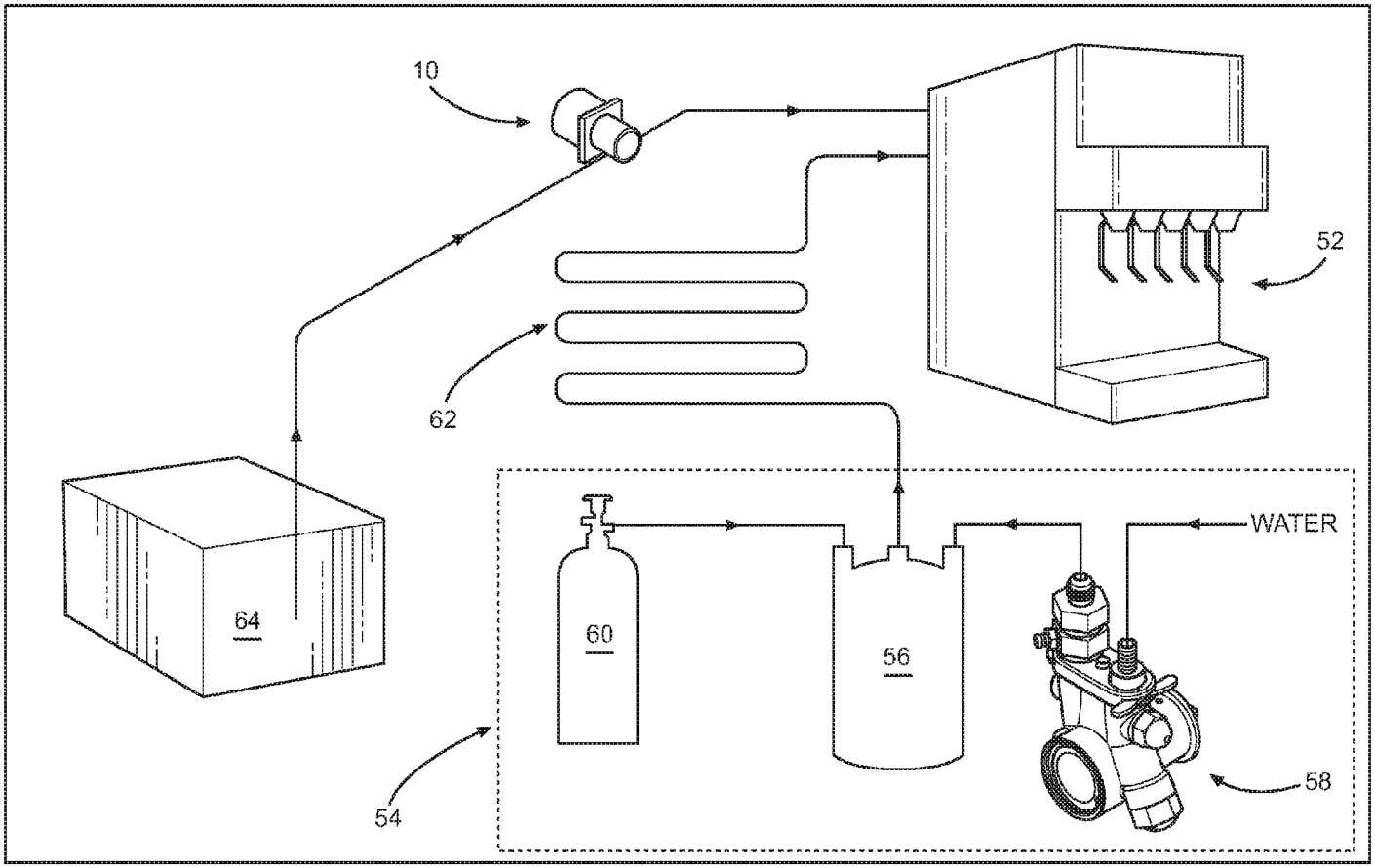
FIG. 8 is schematic diagram illustrating a water carbonation system and a beverage dispenser in accordance with one embodiment of the present disclosure.

In a further aspect, the present disclosure also relates to a post-mix beverage dispenser, which utilizes a pump and controller system as described above. As shown in FIG. 8, the post-mix beverage dispenser 50 includes a beverage mixing and dispensing nozzle 52 and a supply of carbonated water which is in flow communication with the beverage mixing and dispensing nozzle 52. For instance, the beverage dispenser 50 may include a water carbonation system 54, in which a source of non-carbonated water (such as a municipal water supply line) is pumped into a mixing tank 56 by a water pump 58. This mixing tank 56 is also in flow communication with a source of carbon dioxide gas such as a compressed gas cylinder 60. Water is pumped into the mixing tank 56, and carbon dioxide gas is then mixed with, and dissolved into, the water in the mixing tank 56 to provide carbonated water. The carbonated water may also be passed through a chiller 62 before reaching the mixing and dispensing nozzle 52.

In addition, post-mix beverage dispenser 50 also includes a source of concentrated beverage syrup, such as a bag-in-box syrup container 64. The dispensing nozzle 52 is also connected to, and in flow communication, with the bag-in-box or other beverage syrup container 64. The pump and controller system described above may be used to move the syrup from the syrup container 64 to the dispensing nozzle 52. Thus the syrup container 64 is connected to the pump inlet port 14 and the pump outlet port 16 is connected to the beverage mixing and dispensing nozzle 52 in order to supply the beverage syrup for the nozzle 52.

Advantageously then, according to the present disclosure, a post-mix beverage dispenser 50 is disclosed which does not utilize a gas driven diaphragm pump in order to pump the beverage syrup. Thus, the beverage syrup being pumped is no longer in contact with the rubber diaphragms used in such pumps. More preferably, the beverage syrup does not contact any components made from rubber as the syrup moves through the syrup pump. Accordingly, the problem of syrup flavors being absorbed by the rubber components and subsequently leaching out into other beverage syrups (i.e. flavor cross-contamination) is eliminated, and syrup pumps according to the present disclosure may be readily repurposed for different flavored beverages if desired.

In addition, by eliminating the gas driven diaphragm pump, the risk of leakage of carbon dioxide or other inert gases from the diaphragm pump is likewise eliminated.

Thus, the significant confined space asphyxiation hazard presented by such carbon dioxide leaks is also eliminated.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A pump and controller system comprising:

a pump housing having an internal pumping chamber, an inlet port, an outlet port, and a sensor port, each of the ports being in flow communication with the pumping chamber;

a pump motor;

a pumping mechanism driven by the pump motor and at least partially disposed within the pumping chamber, the pumping mechanism being capable of receiving a fluid through the inlet port into the pumping chamber at a first pressure and discharging the fluid from the pumping chamber through the outlet port at a second pressure which is greater than the first pressure;

a pressure transducer disposed adjacent the sensor port, the transducer being in contact with a quantity of the fluid at the second pressure and generating an electrical signal based upon the second pressure;

a programmable micro controller, which receives the electrical signal from the pressure transducer, and is electrically connected to the pump motor and capable of starting and stopping the pump motor, wherein the micro controller is programmed to immediately stop the pump motor when the second pressure exceeds a predetermined maximum pressure level, and wherein the micro controller is programmed to stop the pump motor when the second pressure falls below a predetermined minimum pressure level and remains below the minimum pressure level for a predetermined first time interval.

2. The pump and controller system of claim 1, wherein the pumping mechanism comprises:

a drive gear, having a plurality of drive gear teeth, disposed within the pumping chamber and rotatably driven by the pump motor; and an idler gear, having a plurality of idler gear teeth intermeshed with the drive gear teeth, disposed within the pumping chamber and attached to an idler shaft disposed within the pumping chamber, and wherein the sensor port is located downstream of the drive gear and the idler gear.

3. The pump and controller system of claim 1, wherein the pressure transducer comprises a ceramic piezo disc.

4. The pump and controller system of claim 1, wherein the micro controller is programmed restart the pump motor when, after exceeding the predetermined maximum pressure level, the second pressure falls below the predetermined maximum pressure level.

5. The pump and controller system of claim 1, further comprising a temperature transducer disposed adjacent the sensor port, the temperature transducer being in contact with a quantity of the fluid and generating an electrical signal based upon a temperature of the fluid which is received by the programmable micro controller.

6. The pump and controller system of claim 1, further comprising a data port electrically connected to the micro controller for transmitting data from the micro controller to an external device.

7. The pump and controller system of claim 1, further comprising a wireless transmitter and receiver electrically connected to the micro controller for transmitting data from the micro controller to an external device.

8. A post-mix beverage dispenser comprising:

a beverage mixing and dispensing nozzle;

a supply of carbonated water in flow communication with the beverage mixing and dispensing nozzle;

a supply of beverage syrup; and a beverage syrup pump system having a pump housing having an internal pumping chamber, an inlet port in flow communication with the supply of beverage syrup and with the pumping chamber, an outlet port in flow communication with the pumping chamber and with the beverage mixing and dispensing nozzle, and a sensor port in flow communication with the pumping chamber;

a pumping mechanism driven by a pump motor and at least partially disposed within the pumping chamber, the pumping mechanism being capable of receiving a syrup fluid through the inlet port into the pumping chamber at a first pressure and discharging the fluid from the pumping chamber through the outlet port at a second pressure which is greater than the first pressure;

a pressure transducer disposed adjacent the sensor port, the transducer being in contact with a quantity of the fluid at the second pressure and generating an electrical signal based upon the second pressure;

a programmable micro controller, which receives the electrical signal from the pressure transducer, and is electrically connected to the pump motor and capable of starting and stopping the pump motor, wherein the micro controller is programmed to immediately stop the pump motor when the second pressure exceeds a predetermined maximum pressure level, and wherein the micro controller is programmed to stop the pump motor when the second pressure falls below a predetermined minimum pressure level and remains below the minimum pressure level for a predetermined first time interval.

9. The post-mix beverage dispenser of claim 8, wherein the pumping mechanism comprises:

a drive gear, having a plurality of drive gear teeth, disposed within the pumping chamber and rotatably driven by the pump motor; and an idler gear, having a plurality of idler gear teeth intermeshed with the drive gear teeth, disposed within the pumping chamber and attached to an idler shaft disposed within the pumping chamber, and wherein the sensor port is located downstream of the drive gear and the idler gear.

10. The post-mix beverage dispenser of claim 8, wherein the pressure transducer comprises a ceramic piezo disc.

11. The post-mix beverage dispenser of claim 8, wherein the micro controller is programmed restart the pump motor when, after exceeding the predetermined maximum pressure level, the second pressure falls below the predetermined maximum pressure level.

12. The post-mix beverage dispenser of claim 8, further comprising a temperature transducer disposed adjacent the sensor port, the temperature transducer being in contact with a quantity of the fluid and generating an electrical signal based upon a temperature of the fluid which is received by the programmable micro controller.

13. The post-mix beverage dispenser of claim 8, further comprising a data port electrically connected to the micro controller for transmitting data from the micro controller to an external device.

14. The post-mix beverage dispenser of claim 8, further comprising a wireless transmitter and receiver electrically connected to the micro controller for transmitting data from the micro controller to an external device.

* * * * *